US005406233A

United States Patent [19]

Shih et al.

[11] Patent Number: 5,406,233

[45] Date of Patent: Apr. 11, 1995

[54] TUNABLE STRIPLINE DEVICES

[75] Inventors: Benjamin S. Shih, Pure, Japan; Daniel E. Oates, Belmont, Mass.

[73] Assignee: Massachusetts Institute of Technology, Cambridge, Mass.

[21] Appl. No.: 218,710

[22] Filed: Mar. 28, 1994

Related U.S. Application Data

[63] Continuation of Ser. No. 653,066, Feb. 8, 1991, abandoned.

[51] Int. Cl.[6] ..... H01P 3/08; H01P 9/00

[52] U.S. Cl. ..... 333/161; 333/235; 333/246

[58] Field of Search ..... 333/159, 161, 202–205, 333/219, 235, 238, 246, 156

[56] References Cited

U.S. PATENT DOCUMENTS

| | | | |
|---|---|---|---|
| 3,121,205 | 5/1960 | Foss | 333/233 |
| 3,146,413 | 8/1964 | Butler | 333/161 |
| 3,359,513 | 12/1967 | Kelley | 333/161 |
| 3,405,375 | 10/1968 | Kelley | 333/161 |
| 3,480,088 | 11/1969 | Elliott | 333/202 |
| 3,516,031 | 6/1970 | Commerford | 333/258 |
| 3,539,946 | 11/1970 | Vinding et al. | 332/130 |
| 3,546,633 | 12/1970 | Peppiatt | 333/103 |
| 3,573,666 | 4/1971 | Caffrey | 333/1.1 |
| 3,668,553 | 6/1972 | Dunn et al. | 331/107 G |
| 3,737,816 | 6/1973 | Honicke | 333/209 |
| 3,742,335 | 6/1973 | Konishi | 363/159 |
| 3,857,114 | 12/1974 | Minet et al. | 333/204 |
| 4,320,368 | 3/1982 | Sekiguchi | 333/209 |
| 4,578,656 | 3/1986 | Lacour et al. | 333/204 |
| 4,583,064 | 4/1986 | Makimoto et al. | 333/219 |
| 4,692,727 | 9/1987 | Wakino et al. | 333/235 X |
| 4,768,001 | 8/1988 | Chan-Son-Lint et al. | 333/159 |

FOREIGN PATENT DOCUMENTS

| | | | |
|---|---|---|---|
| 117144 | 12/1975 | Germany . | |
| 127059 | 9/1977 | Germany . | |
| 3204863 | 8/1983 | Germany . | |
| 0006502 | 1/1981 | Japan | 333/204 |
| 62-181505 | 8/1987 | Japan . | |
| 1226411 | 3/1971 | United Kingdom . | |
| 2031658 | 7/1986 | United Kingdom . | |
| 552654 | 4/1977 | U.S.S.R. . | |
| 581535 | 11/1977 | U.S.S.R. . | |
| 1401526 | 6/1988 | U.S.S.R. . | |
| 1246188 | 4/1990 | U.S.S.R. . | |

OTHER PUBLICATIONS

Fonatsch et al. "Continuously Variable Electrical Delay Line", IBM Tech. Discl. Bulletin, vol. 6, No. 1, Jun. 1963, pp. 64, 65.

*Primary Examiner*—Seungsook Ham

*Attorney, Agent, or Firm*—Robert F. O'Connell

[57] ABSTRACT

A stripline device using at least one strip conductor and at least one ground plane separated therefrom by a dielectric substrate. The ground plane is caused to move relative to the strip conductor so as to change the propagation velocity of the stripline device. In a particular embodiment, a layer of piezoelectric material is positioned adjacent the ground plane and a voltage applied to the piezoelectric layer causes its dimensions to change and provide a changing air gap between the substrate and the ground plane to change the propagation velocity accordingly.

17 Claims, 5 Drawing Sheets

TUNABLE STRIPLINE DEVICES

The Government has rights in this invention pursuant to Contract No. F19628-85-C-0002 awarded by United States Air Force.

This is a continuation of application Ser. No. 07/653,066, filed on Feb. 8, 1991, (abandoned).

INTRODUCTION

This invention relates generally to stripline devices for use in handling high frequency signals and, more particularly, to a novel technique for providing tunable stripline devices used as resonators, delay lines, filters, and the like.

BACKGROUND OF THE INVENTION

Stripline devices have found applications in many systems, particularly where extremely high frequency signals are used, i.e. frequencies in the microwave region up to the gigaHertz range. In many such applications, such as stripline resonators, delay lines, filters, and the like, it is desirable that the device be tunable over a reasonable range of resonant frequencies or a reasonable range of propagation velocities. In many applications it is particularly desirable that the technique for tuning the device be such as to maintain the high-Q, or quality factor, thereof over the entire tuning range.

In currently used tuning techniques, stripline resonator devices, for example, use external frequency control circuits utilizing external tunable elements, such as varactors or p-i-n diodes coupled to the resonator device or in the resonator line itself. Such techniques, however, cause a severe deterioration of the quality factor particularly in a device made with superconductive materials so that the desired high-Q requirements of the application cannot be maintained over the tuning range thereof.

Another technique that has been proposed, particularly in superconducting stripline resonators, is to vary the operating temperature of the device. Such an approach, however, has also been found to seriously degrade the Q-factor over the reasonable range involved.

Consequently, it is desirable to devise a technique for tuning a stripline device in such a manner that the required high-Q characteristics thereof are maintained over the frequency range for which the device can be tuned.

BRIEF SUMMARY OF THE INVENTION

In accordance with the invention, in a stripline device having a strip conductor and at least one ground plane positioned adjacent to, and separated from, the strip conductor by a dielectric substrate, the ground plane is arranged to be movable relative to the strip conductor so as to change the capacitance between the strip conductor and the ground plane.

In a particular embodiment, for example, the ground plane is caused to move by positioning a layer of piezoelectric material effectively adjacent the ground plane. A variable voltage from a suitable source thereof is connected across the piezoelectric layer so as to create a variable air gap between the strip conductor and the ground plane, thereby permitting a tuning of the stripline device over a suitable range of propagation velocities without causing a deterioration of the normally high-Q thereof.

DESCRIPTION OF THE INVENTION

The invention can be described in more detail with the help of the accompanying drawings wherein FIG. 1 shows a view in section of a typical stripline device of the prior art;

Figure 1:
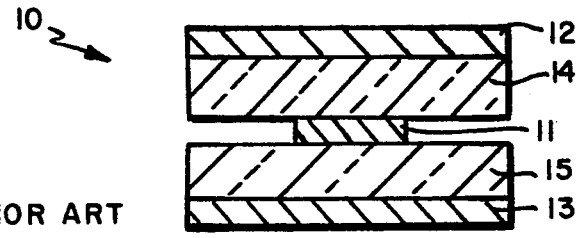
FIG. 1 PRIOR ART

A conventional stripline device 10 is shown in cross section in FIG. 1, wherein a strip conductor 11 is positioned between an upper conductive ground plane 12 and a lower conductive ground plane 13, the strip conductor being separated from the ground planes by dielectric substrates 14 and 15, respectively. Such a structure represents a useful stripline device well-known to those in the art, although variations of the structure thereof, as known to the art, may also be used as described below.

Such a stripline device is normally designed to be operable over a range of propagation velocities, or a range of resonant frequencies, depending on its use as a transmission line or a resonator, for example, as determined by the dimensions of the structure and the properties of the dielectric and conductor materials used therein. It is desirable to make such a device tunable over the desired propagation velocity, or resonant frequency ranges involved, without degrading the quality factor of the device over such range.

Figure 2:
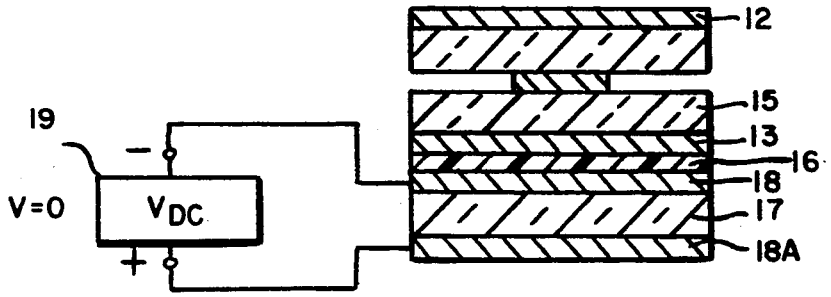
FIG. 2 shows a view in section of an alternative embodiment of a stripline device of FIG. 1 made in accordance with the invention.

In accordance with the invention the velocity of propagation can be varied by changing the effective dielectric constant of the dielectric material present between the two ground planes, e.g., in the embodiment depicted, by changing the dielectric constant between the strip conductor 11 and ground plane 13. Such a change effectively changes the capacitance per unit length of the stripline present therebetween. In a particular embodiment of the invention, for example, a change in capacitance can be achieved by using a layer 17 of a piezoelectric material having conductive layers 18 and 18A affixed thereto and effectively positioned adjacent ground plane 13 via an intermediate layer 16 of a material which is essentially non-expandable affixed to ground plane 13 and conductive layer 18, as shown in FIG. 2. Layer 16 can be any type of material, conductive or non-conductive, so long as it is non-expandable. A variable d-c voltage from a source 19 thereof is supplied across piezoelectric layer 17, the output of source 19 being connected to conductive layers 18 and 18A for such purpose. When the d-c voltage is zero, the dielectric constant between the ground planes is determined by the presence of dielectric substrate 15. Alternatively, non-expandable layer 16 can be placed below the piezoelectric layer adjacent layer 18A and layer 18 can be omitted.

Figure 3:
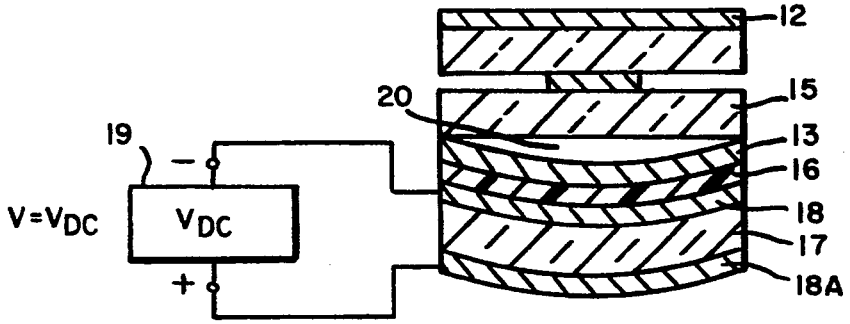
FIG. 3 shows a further view of the device of FIG. 2 for describing the technique for tuning thereof in accordance with the invention.

When a voltage $V_{d\text{-}c}$ is supplied from source 19, as shown in FIG. 3, the dimensions of the piezoelectric layer 17 change, together with layers 18, 16 and ground plane 13, to which it is affixed, so as to create an air gap 20 between dielectric substrate 15 and ground plane 13. For example, a piezoelectric layer, having an appropriate piezoelectric constant and a voltage polarity arranged so that the piezoelectric material expands, causes such material to expand, as shown in FIG. 3. The size of the air gap varies as the applied d-c voltage varies and the capacitance between strip conductor 11 and ground plane 13 changes accordingly.

The presence of an air gap decreases the capacitance per unit length of the strip line and thereby varies the velocity of propagation or the resonant frequency thereof. Thus, a higher velocity of propagation results in an increase in the resonance frequency. It is found that such an approach assures that the high-Q of the device is maintained over the propagation velocity or resonant frequency range desired.

Figure 4:
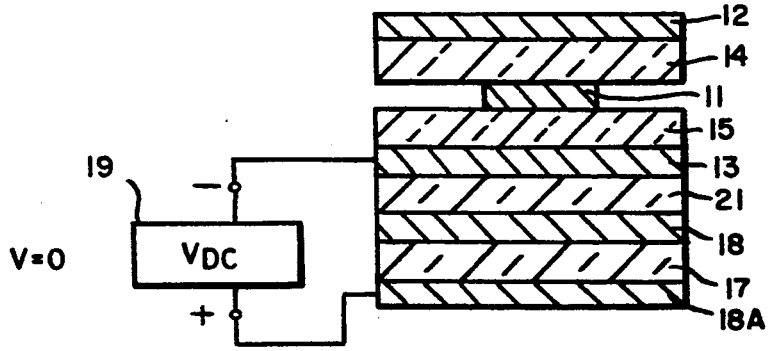
FIG. 4 shows a further alternative embodiment of the device of FIG. 2.
Figure 5:
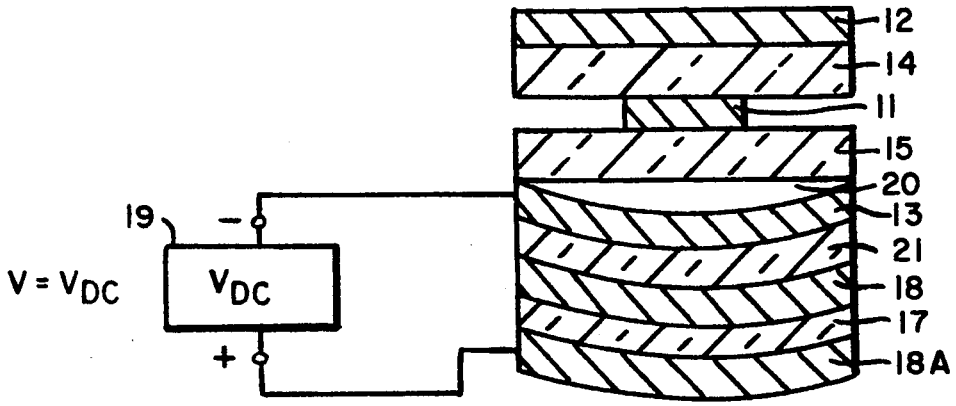
FIG. 5 shows a further view of the device of FIG. 4 for describing the technique for tuning thereof in accordance with the invention.

In an alternative embodiment of the invention, a more effective change in the air gap 20 may be achieved by using an additional piezoelectric element, as shown in FIGS. 4 and 5. As seen therein, layers 16 and 18 can be omitted and the ground plane 13 can be used as a conductive layer to which the d-c voltage from source 19 can be applied. An additional layer 21 of piezoelectric material with a piezoelectric constant having a sign opposite to that of layer 17 is inserted between layer 13 and 18 and layer 16 is omitted. The mechanical forces involved are further enhanced so as to provide a greater air gap variation and, hence, an even wider tuning range for the velocity of propagation or resonant frequency of the device, as shown in FIG. 5. Still further piezoelectric/conductive layers can also be used to advantage in some cases, although in many applications the structures in FIGS. 2 and 3, would still suffice.

Figure 6:
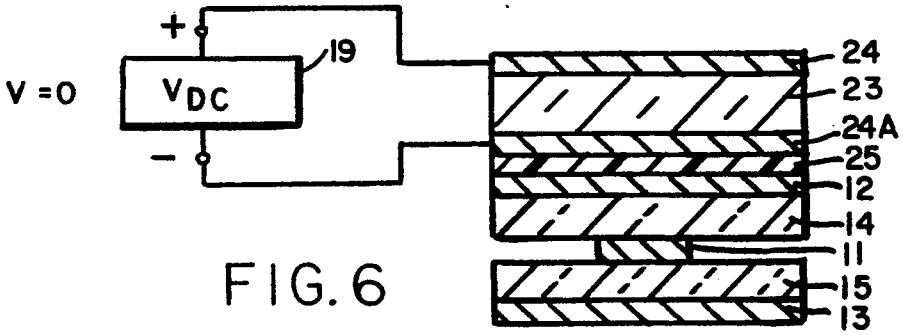
FIG. 6 shows a still further alternative embodiment of the invention used in a stripline device of FIG. 1.
Figure 7:
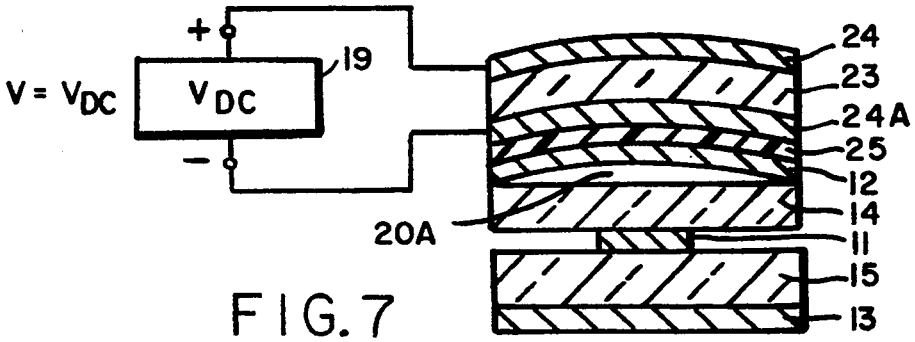
FIG. 7 shows a further view of the device of FIG. 6 for describing the technique for tuning thereof in accordance with the invention.

In a still further embodiment of the invention, a piezoelectric layer, or layers, can be applied to the upper ground plane, as shown in FIGS. 6 and 7, rather than the lower ground plane. Thus, a piezoelectric layer 23 and conductive layers 24 and 24A, together with a non-expandable layer 25 may be used adjacent upper ground plane 12 so as to create an air gap 20A between substrate 14 and ground plane 12 so as to vary the capacitance between strip conductor 11 and ground plane 12, as shown in FIG. 7, in a manner similar to that discussed with reference to the previously described embodiments. Additional piezoelectric/conductive layers, can also be used thereof in a manner similar to that shown in FIGS. 4 and 5.

Figure 7A:
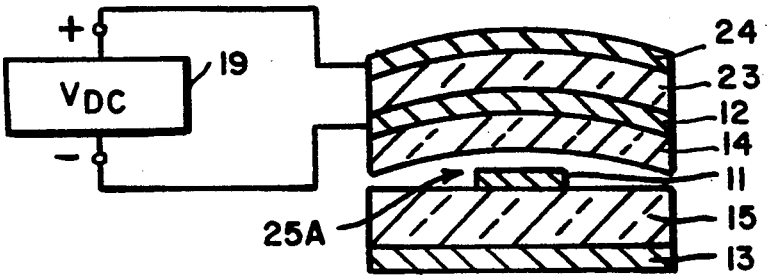
FIG. 7A shows a modification of the device of FIGS. 6 and 7.

A further variation in the configuration of FIG. 7 is shown in FIG. 7A in which layers 24A and 25 can be omitted and substrate 14 is adhered to upper ground plane 12. A d-c voltage applied to layers 12 and 24 across piezoelectric layer 23 will cause air gap 25A to be created below substrate 14 between ground plane 12 and strip conductor 11.

Figure 8:
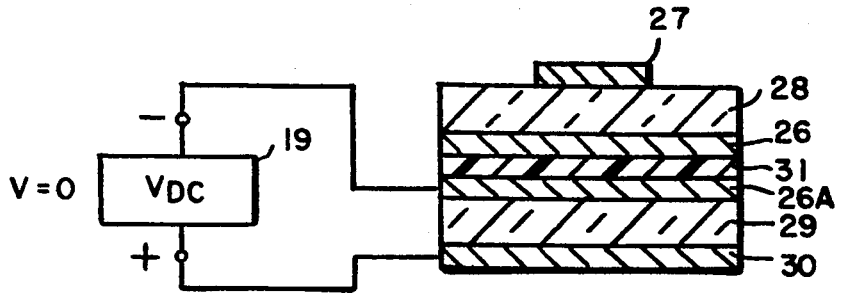
FIG. 8 shows a still further embodiment of the invention as used in a microstripline device.
Figure 9:
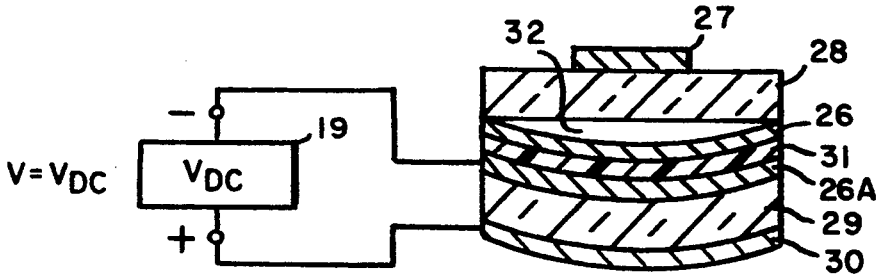
FIG. 9 shows a further view of the device of FIG. 8 for describing the technique for tuning thereof in accordance with the invention.

Further, the invention can be used with other stripline configurations, one such embodiment often referred to as a microstripline in which a single ground plane 26 is used with a strip conductor 27 separated by a dielectric substrate 28. In accordance with the invention, a piezoelectric layer 29 and conductive layers 26A and 30, together with a non-expandable layer 31 affixed thereto, as shown in FIG. 8, are used so that by applying a varying d-c voltage from a source 19 across conductive layers 26A and 30, a varying air gap 32 is created between substrate 28 and ground plane 26, as shown in FIG. 9.

Figure 10:
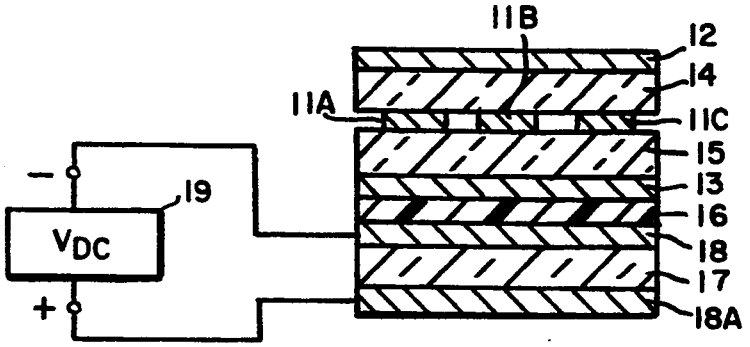
FIG. 10 shows an embodiment of the invention as used in a stripline device having multiple strip conductors.
Figure 11:
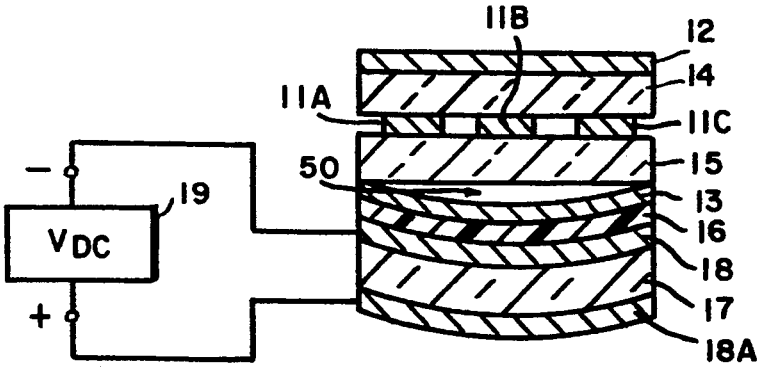
FIG. 11 shows a further view of the device of FIG. 10 for describing the technique for tuning thereof in accordance with the invention.

The approaches described above have been discussed with reference to stripline structures using a single strip conductor. It is clear that such approaches can also be used with stripline devices using multiple strip conductors. As shown in FIGS. 10 and 11, a stripline structure using three strip conductors 11A, 11B, and 11C having common upper and lower ground planes 12 and 13, respectively, is shown in a configuration comparable to that depicted in FIG. 2. The application of a varying d-c voltage across piezoelectric layer 17 provides a varying air gap 50 between the strip conductor and common lower ground plane 13 so as to provide appropriate tuning of the propagation velocity/resonant frequencies with respect to each strip conductor/ground plane combination.

Figure 12:
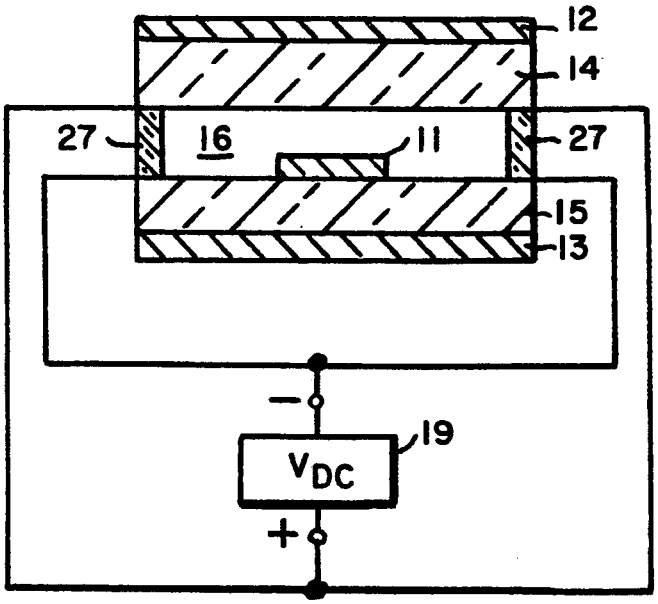
FIG. 12 shows a still further alternative embodiment of the invention of use in a modification of a stripline device of FIG. 1.
Figure 13:
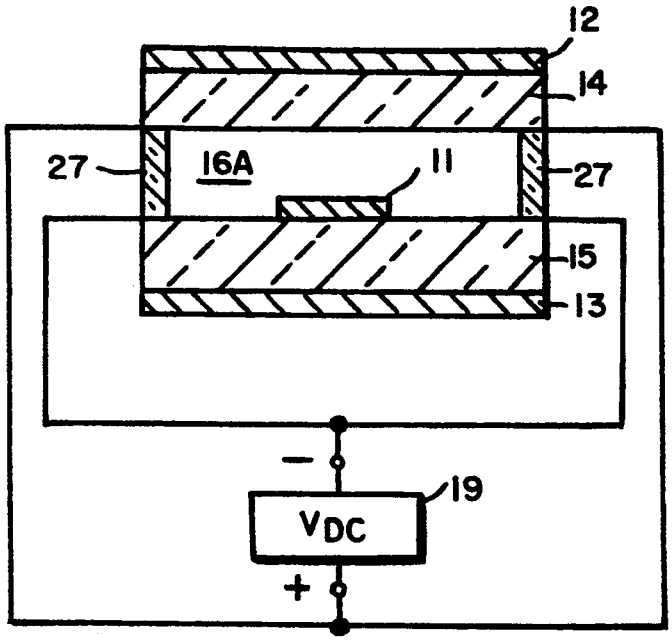
FIG. 13 shows a further view of the device of FIG. 12 for describing the techniques for tuning thereof in accordance with the invention.

A still further embodiment of the invention is shown in FIGS. 12 and 13 wherein the dielectric substrates 14 and 15 are separated by a pair of piezoelectric elements 27 so as to create an air gap 16 between strip conductor 11 and substrate 14 and, accordingly, between strip conductor 11 and upper ground plane 12. A variable d-c voltage source 19 is connected in parallel across both piezoelectric elements 27 as shown.

When a d-c voltage is applied to the piezoelectric elements, they become lengthened (or shortened) as shown in FIG. 13 so as to increase (or decrease) the air gap 16 and, accordingly, change the propagation velocity/resonant frequency of the device. Thus, the device can be tuned over a range thereof by varying the d-c voltage applied thereto.

Although the structures discussed above provide an effective technique for tuning stripline devices, as depicted therein, by merely changing the d-c voltage supplied to one or more piezoelectric layers, the variable air gap desired can be created in accordance with the invention using other means for such purpose.

Figure 14:
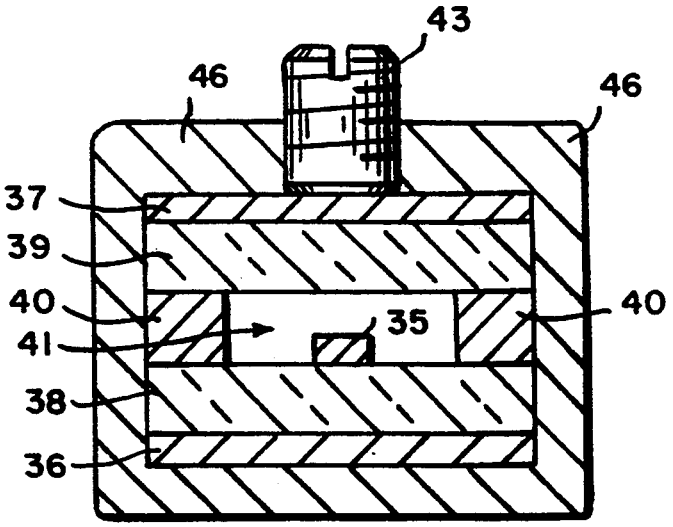
FIG. 14 shows a still further embodiment of the invention as used in a modification of a stripline device of FIG. 1.
Figure 15:
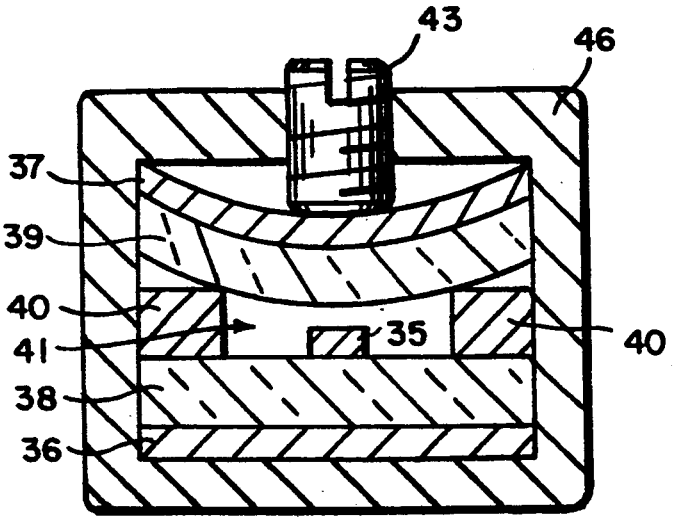
FIG. 15 shows a further view of the device of FIG. 14 for describing the technique for tuning thereof in accordance with the invention.

A still further alternative embodiment of the invention using a mechanical implementation of the invention, for example, is depicted in FIGS. 14 and 15 for use in a stripline device comprising a strip conductor 35 positioned between lower and upper ground planes 36 and 37, respectively. In the embodiment shown, the strip conductor is affixed adjacent a dielectric substrate 38 located between strip conductor 35 and lower ground plane 36. A further dielectric substrate 39 is located adjacent upper ground plane 37 and is physically separated from strip conductor 35 by spacer/elements 40, thereby creating an air gap 41 between conductor 35 and upper dielectric substrate 39.

A vertically movable screw element 43 is positioned at the top of the device so as to be in contact with the top surface of upper ground plane element 37. The overall device is enclosed in a suitable housing 46.

When screw element 43 is rotated so as to cause it to move vertically downwardly as shown in FIG. 15, pressure is applied to upper ground plane 37 and dielectric substrate 39 thereby deforming the latter elements as shown so as to decrease the size of the air gap 41 and, hence, increase the capacitance of the device. The propagation velocity and the resonant frequency of the device each decrease accordingly, thereby providing a mechanism for tuning the device over a range thereof.

It was found that the quality factor of the device is also effectively maintained over the tuning range desired when using the approach depicted in FIGS. 14 and 15. For example, in a specific exemplary operating embodiment thereof, using superconductive niobium, a Q of 80,000 was maintained, within 7% , over a tuning range of 6.9 MHz at a center frequency of 1.0 GigaHz.

While the above described specific embodiments of the invention represent preferred embodiments thereof, modification thereto will occur to those in the art within the spirit and scope of the invention. Hence, the invention is not to be construed as limited to the specific embodiments disclosed, except as defined by the appended claims.

What is claimed is:

1. A stripline device comprising at least one strip conductor;

at least one ground plane positioned adjacent to and separated from said at least one strip conductor by a dielectric substrate; and means for moving said at least one ground plane relative to said at least one strip conductor so as to change the propagation velocity of said stripline device, wherein said moving means comprises a layer of piezoelectric material positioned effectively adjacent said at least one ground plane;

first and second layers of conductive material positioned on opposite sides of said layer of piezoelectric material; and a voltage source connected to said first and second layers of conductive material for applying a voltage across said piezoelectric material, said piezoelectric material changing its shape in response to changes in voltage from said voltage source so as to change the propagation velocity in response to changes in said voltage.

2. A stripline device in accordance with claim 1, wherein said at least one ground plane is a single ground plane and a change in the shape of said piezoelectric layer produces an air gap between said dielectric substrate and said single ground plane, the size of said air gap changing in response to changes in said voltage.

3. A stripline device in accordance with claim 2, and further including a layer of non-expandable material positioned between and affixed to said single ground plane and said first layer of conductive material.

4. A stripline device in accordance with claim 1 wherein said at least one ground plane includes an upper ground plane positioned adjacent an upper side of said at least one strip conductor and separated therefrom by said dielectric substrate and a lower ground plane positioned adjacent a lower side of said at least one strip conductor and separated therefrom by a second dielectric substrate, said layer of piezoelectric material being positioned adjacent to one of said upper and lower ground planes.

5. A stripline device in accordance with claim 4, wherein said layer of piezoelectric material is positioned effectively adjacent said lower ground plane.

6. A stripline device in accordance with claim 4, wherein said layer of piezoelectric material is positioned effectively adjacent said upper ground plane.

7. A stripline device in accordance with claims 2 or 3, wherein said single lower ground plane is adjacent a lower side of said at least one strip conductor and is separated therefrom by said dielectric substrate, said layer of piezoelectric material being positioned effectively adjacent said single lower ground plane.

8. A stripline device in accordance with claim 1, wherein said at least one ground plane is a lower ground plane positioned adjacent a lower side of said at least one strip conductor and separated therefrom by said dielectric substrate and further including an upper ground plane positioned adjacent an upper side of said at least one strip conductor and separated therefrom by a further dielectric substrate; said moving means moving said lower ground plane relative to said at least one strip conductor.

9. A stripline device in accordance with claim 1 wherein the change in the shape of said piezoelectric layer produces an air gap between said dielectric substrate and said at least one ground plane, the size of said air gap changing in response to changes in said voltage.

10. A stripline device in accordance with claim 1 wherein said at least one strip conductor comprises a single strip conductor.

11. A stripline device in accordance with claim 1 wherein said at least one strip conductor comprises a plurality of strip conductors.

12. A stripline device comprising at least one strip conductor;

a first layer of conductive material positioned adjacent to and separated from said at least one strip conductor by a dielectric substrate, said first layer of conductive material forming at least one ground plane;

a first layer of piezoelectric material positioned adjacent to said first layer of conductive material;

a second layer of conductive material positioned adjacent said first layer of piezoelectric material;

a second layer of piezoelectric material positioned adjacent said second layer of conductive material;

a third layer of conductive material positioned adjacent said second layer of piezoelectric material;

a voltage source connected to said first layer of conductive material and said third layer of conductive material whereby said layers of piezoelectric material change their shapes in response to changes in voltage from said voltage source for moving said first layer of conductive material relative to said at least one strip conductor so as to change the propagation velocity of said stripline device in response to changes in said voltage.

13. A stripline device in accordance with claim 12 wherein said first layer of conductive material forms an upper ground plane positioned adjacent an upper side of said at least one strip conductor and separated therefrom by said dielectric substrate and further including a lower ground plane positioned adjacent a lower side of said at least one strip conductor and separated therefrom by a second dielectric substrate, and further wherein said first layer of piezoelectric material, said second layer of conductive material, and said second layer of piezoelectric material are provided effectively adjacent to said upper or lower ground planes.

14. A strip line device in accordance with claim 13 wherein said first layer of piezoelectric material and said second layer of piezoelectric material are positioned effectively adjacent said lower ground plane.

15. A strip line device in accordance with claim 13 wherein said first layer of piezoelectric material and said second layer of piezoelectric material are positioned effectively adjacent said upper ground plane.

16. A stripline device comprising at least one strip conductor; an upper and lower ground plane positioned above and below said at least one strip conductor and separated therefrom by respective dielectric substrates, one of said substrates being adjacent said at least one strip conductor;

a moving means including one or more piezoelectric elements positioned between said dielectric substrates so that one of said substrates is adjacent said at least one strip conductor and the other of said substrates is separated from said at least one strip conductor by an air gap;

a voltage source connected across said one or more piezoelectric elements, said one or more piezoelectric elements changing their dimensions in response to changes in voltage from said voltage source so as to change the dimensions of said air gap to change the propagation velocity of the stripline device.

17. A stripline device in accordance with claim 16 wherein said one or more piezoelectric elements comprise two said elements, said voltage source being connected in parallel across said elements so as to cause them to elongate when said voltage is applied thereto.

* * * * *